US010113388B2

(12) United States Patent
Stewart et al.

(10) Patent No.: US 10,113,388 B2
(45) **Date of Patent: *Oct. 30, 2018**

(54) APPARATUS AND METHOD FOR PROVIDING WELLBORE ISOLATION

(71) Applicant: Halliburton Energy Services, Inc., Houston, TX (US)

(72) Inventors: Takao Stewart, Chickasha, OK (US); Robert Lee Pipkin, Marlow, OK (US); Eric Bivens, Denver, CO (US); Fraser McNeil, Houston, TX (US); Michael Bailey, Duncan, OK (US); Tim Holiman Hunter, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 454 days.

This patent is subject to a terminal disclaimer.

(21) Appl. No.: 14/670,057

(22) Filed: Mar. 26, 2015

(65) Prior Publication Data

US 2015/0198007 A1 Jul. 16, 2015

Related U.S. Application Data

(63) Continuation of application No. 13/271,801, filed on Oct. 12, 2011, now Pat. No. 9,016,390.

(51) Int. Cl.

| | |
|---|---|
| ***E21B 33/126*** | (2006.01) |
| ***E21B 33/128*** | (2006.01) |
| ***E21B 23/06*** | (2006.01) |

(52) U.S. Cl.

CPC ..... *E21B 33/1285* (2013.01); *E21B 23/06* (2013.01); *E21B 33/126* (2013.01)

(58) Field of Classification Search

CPC .... E21B 33/1285; E21B 33/06; E21B 33/126; E21B 33/128; E21B 33/122; E21B 33/124

See application file for complete search history.

(56) References Cited

U.S. PATENT DOCUMENTS

| | | | |
|---|---|---|---|
| 2,330,259 | A | 9/1943 | Baker |
| 2,343,075 | A | 2/1944 | Otis |

(Continued)

OTHER PUBLICATIONS

Second Examiner's Letter issued by the Canadian Patent Office regarding related application 2,850,611, dated Feb. 4, 2016, 3 pages.

(Continued)

*Primary Examiner* — Taras P Bemko

(74) *Attorney, Agent, or Firm* — Haynes and Boone LLP

(57) ABSTRACT

An actuatable wellbore isolation assembly including a housing defining an axial flowbore and including a mandrel portion, a first end portion, and a second end portion; a radially expandable isolating member positioned circumferentially about the housing; a sliding sleeve circumferentially positioned about the mandrel, the sliding sleeve being movable from a first position, in which the sliding sleeve retains the isolating member in a narrower non-expanded conformation, to a second position, in which the sliding sleeve does not retain the isolating member in the narrower non-expanded conformation; and an actuator assemblage configured to allow movement of the sliding sleeve from the first to the second position. In an exemplary embodiment, the actuator assemblage includes a biasing chamber having a biasing member disposed therein, wherein the biasing member is configured to apply a force to the sliding sleeve to move the sliding sleeve from the first to the second position.

16 Claims, 5 Drawing Sheets

(56) References Cited

U.S. PATENT DOCUMENTS

| | | | |
|---|---|---|---|
| 5,413,180 | A | 5/1995 | Ross et al. |
| 5,803,177 | A | 9/1998 | Hriscu et al. |
| 6,325,151 | B1 | 12/2001 | Vincent et al. |
| 7,051,812 | B2 | 5/2006 | McKee et al. |
| 7,648,179 | B2 | 1/2010 | Webb et al. |
| 7,677,302 | B2 | 3/2010 | Ehtesham et al. |
| 7,681,654 | B1 | 3/2010 | Cugnet |
| 7,886,842 | B2 | 2/2011 | Howard et al. |
| 7,909,094 | B2 | 3/2011 | Schultz et al. |
| 2011/0139453 | A1 | 6/2011 | Schultz et al. |
| 2011/0209881 | A1 | 9/2011 | Hriscu et al. |

OTHER PUBLICATIONS

Notice of Allowance issued by the Canadian Patent Office regarding related application 2,850,611, dated Jun. 23, 2016, 1 page.

Patent Examination Report No. 1 issued by IP Australia regarding related application No. 2015243045 dated Jul. 6, 2016, 6 pages.

International Search Report and Written Opinion issued by the European Patent Office regarding related application PCT/US2012/056914, dated Apr. 3, 2013.

Patent Examination Report No. 1 issued by the Australian Patent Office regarding related application 2012321234, dated May 4, 2015.

First Examiner's Letter issued by the Canadian Patent Office regarding related application 2,850,611, dated May 29, 2015.

APPARATUS AND METHOD FOR PROVIDING WELLBORE ISOLATION

CROSS-REFERENCE TO RELATED APPLICATION

This application is a continuation of U.S. application Ser. No. 13/271,801, filed Oct. 12, 2011, the entire disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells are often serviced by stimulation operations such as hydraulic fracturing operations, acidizing treatments, perforating operations, or the like. Such a subterranean formation servicing operations may increase hydrocarbon production from the well. Often, it may be desirable to fluidly isolate two or more adjacent portions or zones of a wellbore during the performance of such servicing operations, for example, such that each zone of the wellbore may be individually serviced.

Cup tools have been utilized conventionally to fluidly isolate a given zone of a wellbore from an adjacent zone, for example, such that fluid movement in at least one direction is restricted, impaired, and/or prohibited via the utilization of such a cup tool. However, conventional cup tools have proven unreliable and/or unsuitable for use in the performance of servicing operations in certain settings. Particularly, conventional cup tools may lose integrity (e.g., by degradation or wear) as they are moved through a tubing string (such as the casing string and/or liner) and into position for the servicing operation, rendering such conventional cup tools unreliable and unsuitable for use in some wellbore servicing operations.

Accordingly, there exists a need for an improved apparatus for isolating a wellbore and method of using the same.

SUMMARY

Disclosed herein is an actuatable wellbore isolation assembly comprising a housing generally defining an axial flowbore and comprising a mandrel portion, a first end portion, and a second end portion, a radially expandable isolating member positioned circumferentially about a portion of the housing, a sliding sleeve circumferentially positioned about a portion of the mandrel of the cylindrical housing, the sliding sleeve being movable from, a first position in which the sliding sleeve retains the expandable isolating member in a narrower non-expanded conformation to a second position in which the sliding sleeve does not retain the expandable isolating member in the narrower non-expanded conformation, and an actuator assemblage configured to selectively allow movement of the sliding sleeve from the first position to the second position.

Further disclosed herein is an actuatable wellbore isolation system comprising a wellbore stimulation assembly, wherein the wellbore stimulation assembly is incorporated within a work string, and a first actuatable wellbore isolation assembly, wherein the first actuatable wellbore isolation assembly is incorporated within the work string above the wellbore stimulation assembly, the first actuatable wellbore isolation assembly comprising a housing generally defining an axial flowbore and comprising a mandrel portion, a first end portion, and a second end portion, a radially expandable isolating member positioned circumferentially about a portion of the housing, a sliding sleeve circumferentially positioned about at portion of the mandrel of the cylindrical housing, the sliding sleeve being movable from, a first position in which the sliding sleeve retains the expandable isolating member in a narrower non-expanded conformation to a second position in which the sliding sleeve does not retain the expandable isolating member in the narrower non-expanded conformation, and an actuator assemblage configured to selectively allow movement of the sliding sleeve from the first position to the second position.

Also disclosed herein is a wellbore isolation method comprising positioning a work string within a wellbore, wherein the work string comprises a wellbore servicing tool, wherein the wellbore servicing tool is incorporated within the work string, and a actuatable wellbore isolation assembly, wherein the actuatable wellbore isolation assembly is incorporated within the work string above the wellbore stimulation assembly, the actuatable wellbore isolation assembly comprising a housing generally defining an axial flowbore and comprising a mandrel portion, a first end portion, and a second end portion, a radially expandable isolating member positioned circumferentially about a portion of the housing, a sliding sleeve circumferentially positioned about a portion of the mandrel of the cylindrical housing, the sliding sleeve being movable from, and an actuator assemblage configured to selectively allow movement of the sliding sleeve from the first position to the second position, actuating the actuatable wellbore isolation assembly, wherein actuating the actuatable wellbore isolation assembly comprises transitioning the sliding sleeve from a) a first position in which the sliding sleeve retains the expandable isolating member in a narrower non-expanded conformation to b) a second position in which the sliding sleeve does not retain the expandable isolating member in the narrower non-expanded conformation, and communicating a wellbore servicing fluid via the wellbore servicing tool, wherein the actuatable wellbore isolation assembly substantially restricts fluid movement in at least one direction via an annular space between the work string and an inner surface of the wellbore.

Also disclosed herein is a wellbore isolation assembly comprising a housing generally defining an axial flowbore and comprising a mandrel portion, a first end portion, and a second end portion, a cup packer positioned circumferentially about a portion of the housing, wherein the cup packer comprises a concave surface, and wherein the cup packer is configured to expand radially upon application of a fluid pressure to the concave surface, a sliding sleeve circumferentially positioned about a portion of the mandrel of the cylindrical housing, the sliding sleeve being movable from, a first position in which the sliding sleeve retains the cup packer in a narrower non-expanded conformation and the concave surface of the cup packer is not exposed, a second position in which the sliding sleeve does not retain the cup packer in the narrower non-expanded conformation and the concave surface is exposed, and an actuator assemblage configured to selectively allow movement of the sliding sleeve from the first position to the second position.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
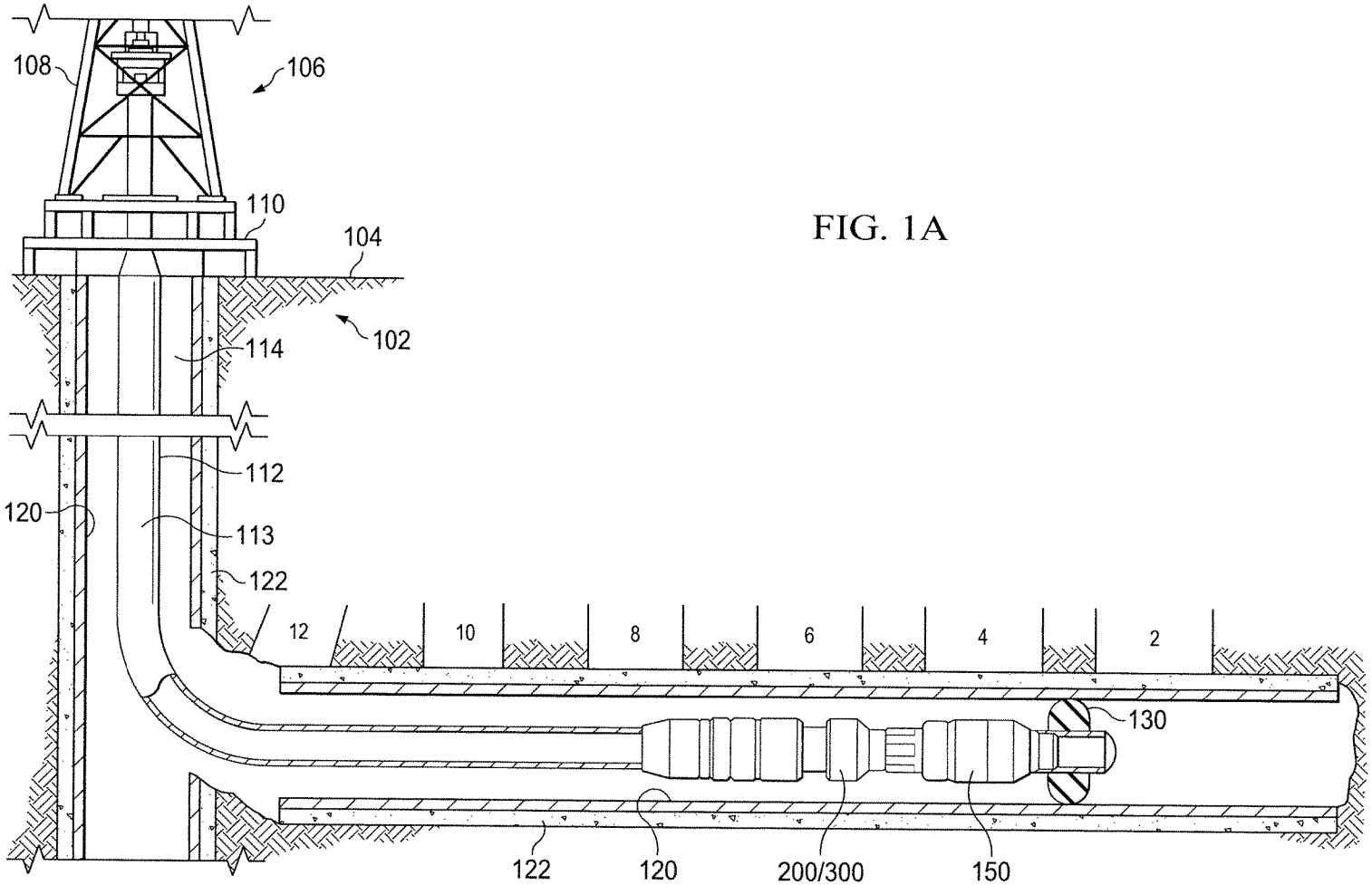
FIG. 1A is a partial cut-away view of an embodiment of a wellbore servicing system comprising an actuatable isolation assembly (AIA) according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more of embodiments of an actuatable isolation assembly (AIA). An AIA, as disclosed herein, may be employed to restrict the movement of fluid via an annular space between the AIA and a tubing string in which the AIA is positioned in at least one direct. Also disclosed herein are one or more embodiments of a wellbore servicing system comprising one or more AIAs. Also disclosed herein are one or more embodiments of a method of servicing a wellbore employing one or more AIAs.

Figure 1B:
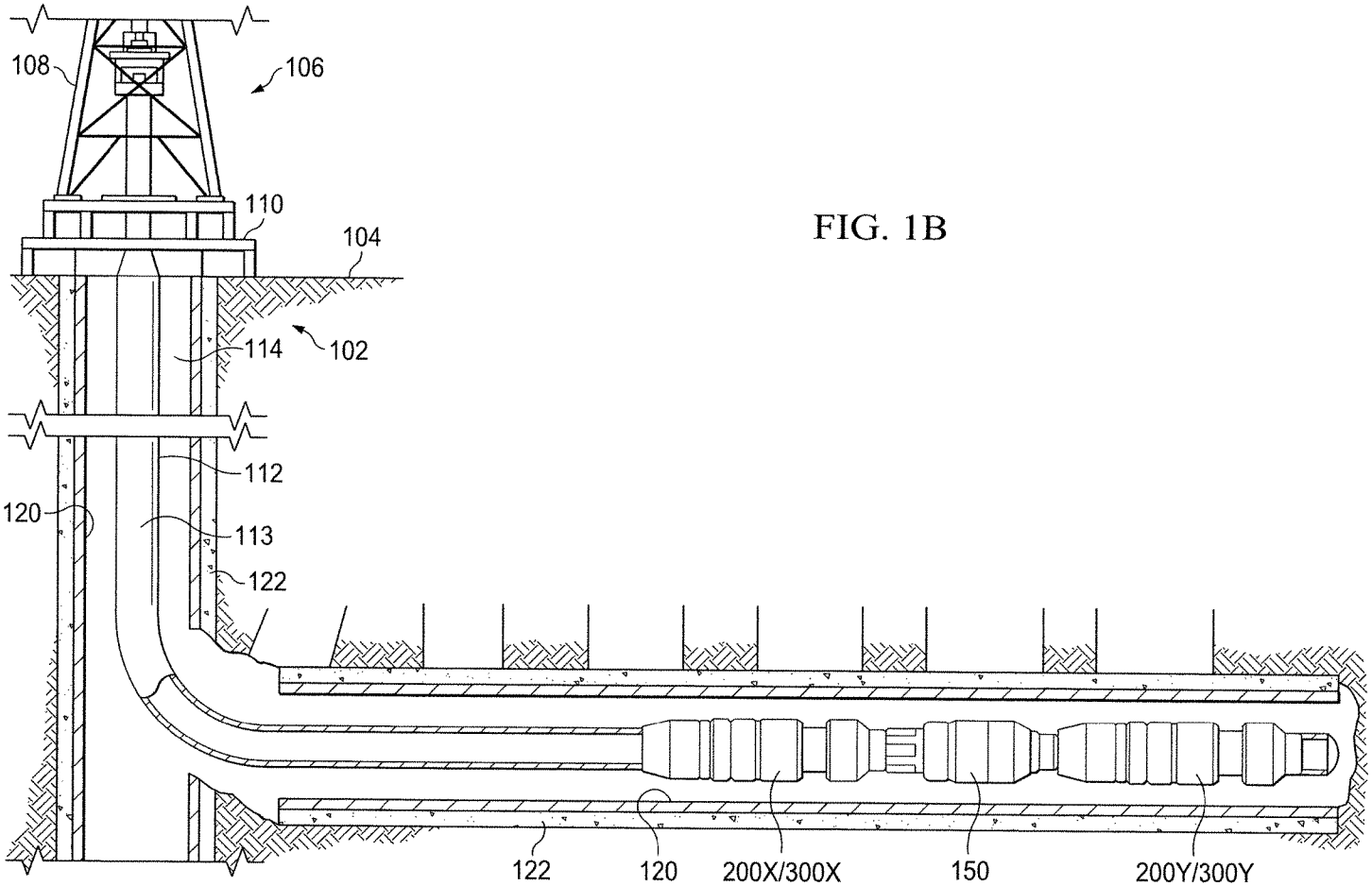
FIG. 1B is a partial cut-away view of an embodiment of a wellbore servicing system comprising multiple AIAs according to the disclosure.

Referring to FIGS. 1A and 1B, embodiments of an operating environment in which such wellbore isolation apparatuses, systems, and methods may be employed are illustrated. It is noted that although some of the figures may exemplify horizontal or vertical wellbores, the principles of the apparatuses, systems, and methods disclosed herein may be similarly applicable to horizontal wellbore configurations, conventional vertical wellbore configurations, and combinations thereof. Therefore, the horizontal or vertical nature of any figure is not to be construed as limiting the wellbore to any particular orientation.

As depicted in FIGS. 1A and 1B, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which a work string 112 (e.g., a drill string, a tool string, a segmented tubing string, a jointed tubing string, or any other suitable conveyance, or combinations thereof) generally defining an axial flowbore 113 may be positioned within or partially within the wellbore 114. In an embodiment, the work string 112 may comprise two or more concentrically positioned strings of pipe or tubing (e.g., a first work string may be positioned within a second work string, for example, providing an annular space there-between). The drilling or servicing rig 106 may be conventional and may comprise a motor driven winch and other associated equipment for lowering the work string 112 into the wellbore 114. Alternatively, a mobile workover rig, a wellbore servicing unit (e.g., coiled tubing units), or the like may be used to lower the work string 112 into the wellbore 114. While FIG. 1 depicts a stationary drilling rig 106, one of ordinary skill in the art will readily appreciate that mobile workover rigs, wellbore servicing units (such as coiled tubing units), and the like may be similarly employed.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In the embodiment of FIGS. 1A and 1B, at least a portion of the wellbore 114 is lined with a casing or liner 120 that is secured into position against the formation 102 in a conventional manner using cement 122. In alternative operating environments, the wellbore 114 may be partially or fully uncased and/or uncemented. In an alternative embodiment, a portion of the wellbore may remain uncemented, but may employ one or more packers (e.g, a swellable packer, such as Swellpackers™, commercially available from Halliburton Energy Services, Inc.) to isolate two or more adjacent portions or zones within the wellbore 114.

In the embodiment of FIG. 1A, the work string 112 comprises, incorporated therein, a packer 130, a wellbore stimulation assembly (WSA) 150, and an AIA 200 and/or 300. Unless otherwise provided, reference herein to AIA 200 and/or 300 is understood to include the AIA 200 of FIGS. 2A-2C or AIA 300 of FIGS. 3A-3B. In the embodiment of FIG. 1, the packer 130 may positioned below (e.g., downhole from) the WSA 150, the AIA 200 may be positioned above (e.g., uphole from) the WSA 150, and the WSA 150 may be positioned proximate and/or substantially adjacent to a first subterranean formation zone (or "pay zone") 2, alternatively, a second, third, fourth, fifth, or sixth zone, 4, 6, 8, 10, or 12, respectively. As such, the packer 130 and the AIA 200/300 may serve to isolate the first subterranean formation zone 2 for treatment via the WSA 150. In the embodiment of FIG. 1A, the AIA 200 and/or 300, when actuated, may be configured to restrict the upward movement of fluid within the casing or liner 120. Although the embodiment of FIG. 1A illustrates a single AIA, one of skill in the art viewing this disclosure will appreciate that any suitable number and/or orientation of AIAs may be similarly incorporated within a work string such as work string 112, and such AIA may be the same or different (e.g., any suitable combination of RIAs 200/300).

For example, in the embodiment of FIG. 1B, the work string 112 comprises, incorporated therein, an upper AIA 200X, a WSA 150, and a lower AIA 200Y. In the embodiment of FIG. 1B, the upper AIA 200X, when actuated, may be configured to restrict the upward movement of fluid within the casing or liner 120 and the lower AIA 200Y, when actuated, may be configured to restrict the downward movement of fluid within the casing or liner 120. As such, the AIA 200X and 200Y may serve to isolate the first subterranean formation zone 2 for treatment via the WSA 150.

In an embodiment, the packer 130 may be generally configurable to engage (e.g., substantially sealingly and/or immovably) an interior wall of a tubing string (e.g., a casing string, a liner, or the like) and/or an interior wall of the wellbore 114. Any suitable type and/or configuration of packer may be employed. Suitable types and configurations of packers will be appreciated by one of skill in the art viewing this disclosure and generally include mechanical packers and swellable packers (e.g., Swellpackers™, commercially available from Halliburton Energy Services, Inc.).

In an embodiment, the WSA 150 may be generally configurable to selectively communicate a wellbore servicing fluid to the proximate and/or substantially adjacent subterranean formation 102 at a desirable rate and/or pressure. In an embodiment, the WSA 150 may be transitionable between an activated and an inactivated configuration. The WSA 150 may comprise one or more fluid ports for through which the wellbore servicing fluid may be communicated. The ports may be fitted with one or more pressure-altering devices (e.g., nozzles, erodible nozzles, or the like). In an additional embodiment, the ports may be fitted with plugs, screens, covers, or shields, for example, to prevent debris from entering the ports. Examples of such a wellbore servicing fluid include but are not limited to a fracturing fluid, a perforating or hydrajetting fluid, an acidizing fluid, the like, or combinations thereof. The wellbore servicing fluid may be communicated at a suitable rate and pressure. For example, the wellbore servicing fluid may be communicated at a rate and/or pressure sufficient to initiate or extend a fluid pathway (e.g., a perforation or fracture) within the subterranean formation 102. In an embodiment, the WSA 150 may comprise any suitable type or configuration of tool, such as a perforating and/or fracturing tool comprising a plurality of nozzles and configured to emit a particle-laden fluid.

In one or more of the embodiments disclosed herein, an AIA (cumulatively and non-specifically referred to as AIA 200 and/or, in an alternative embodiment, AIA 300) generally comprises a housing, an isolating member, a sliding sleeve, and an actuator assemblage. In one of more of the embodiments disclosed herein, the AIA 200 and/or 300 may be transitionable from a "first" mode or configuration to a "second" mode or configuration.

In an embodiment, when the sliding sleeve is in the first position, the AIA 200 and/or 300 may be characterized as configured in the first mode, also referred to as a "locked," "run-in," or "installation," mode or configuration. In the first mode, the AIA 200 and/or 300 may be configured such that the isolating member is retained in the non-expanded conformation.

In an embodiment, when the sliding sleeve is in the second position, the AIA 200 and/or 300 may be characterized as in the second mode, also referred to as an "actuated" or "operational" mode or configuration. In the second mode, the AIA 200 and/or 300 may be configured such that the isolating member is not retained in the non-expanded conformation (e.g., the isolating member is partially or fully expanded).

Figure 2A:
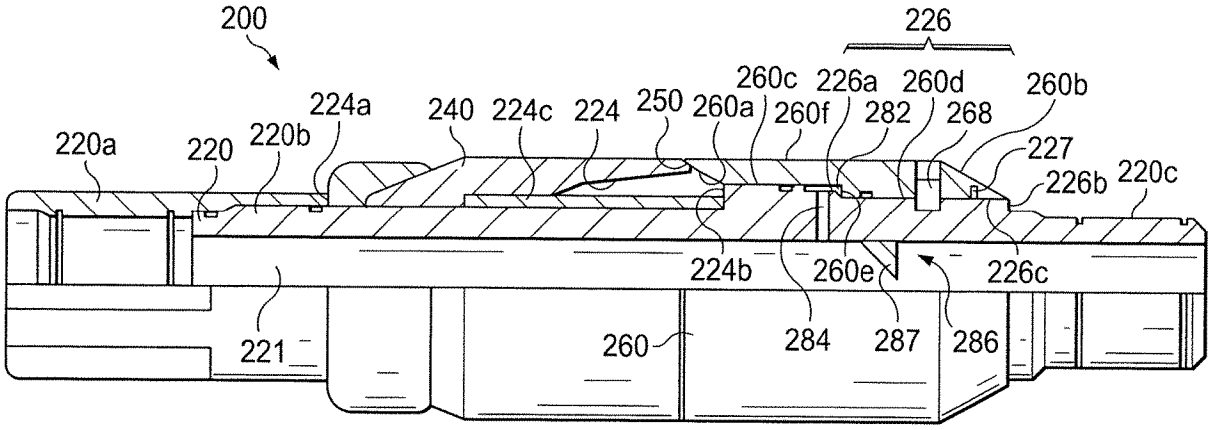
FIG. 2A is a cross-sectional view of a first embodiment of an AIA having an isolating member retained in an unexpanded conformation.
Figure 2B:
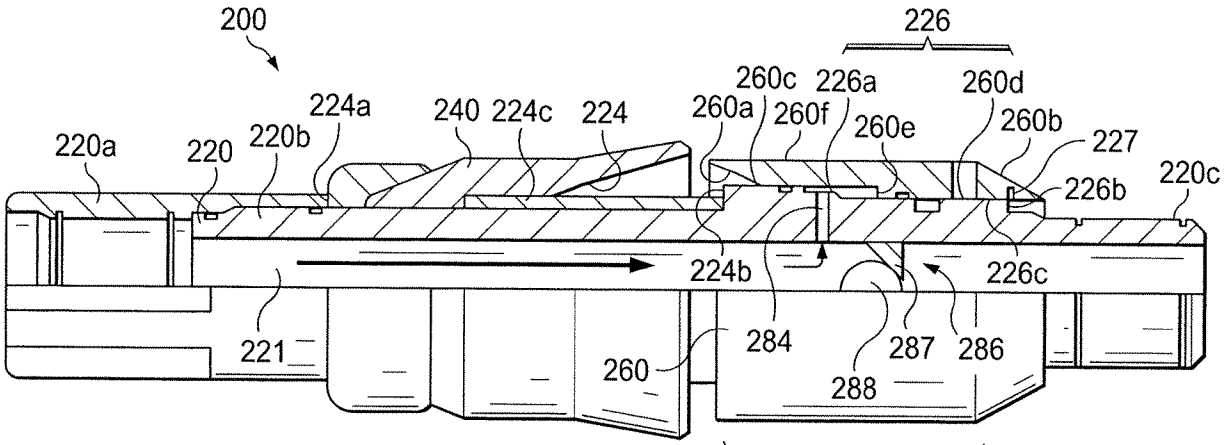
FIG. 2B is a cross-sectional view of the first embodiment of the AIA having an isolating member in an expanded conformation.
Figure 2C:
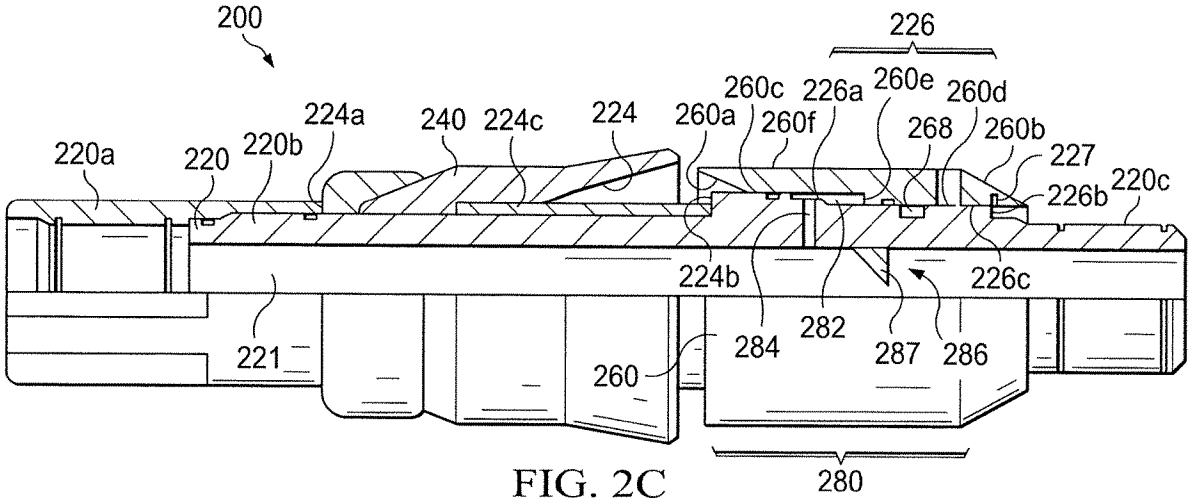
FIG. 2C is a cross-sectional view of the first embodiment of the AIA having an isolating member in an expanded conformation and an unobstructed flowbore.

Referring to FIG. 2A, a first embodiment of an AIA 200 is illustrated in the first, locked mode and, referring to FIGS. 2B and 2C, the AIA 200 is illustrated in the second, actuated mode. In the embodiments of FIGS. 2A, 2B, and 2C, the AIA 200 generally comprises a housing 220, an isolating member 240, a sliding sleeve 260, and an actuator assemblage 280.

Figure 3A:
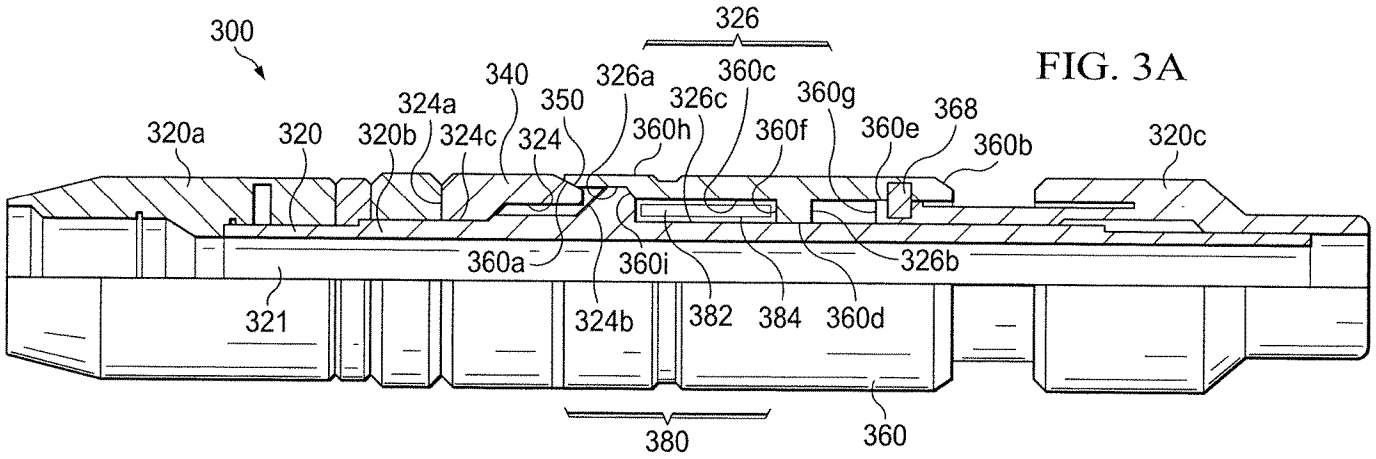
FIG. 3A is a cross-sectional view of a second embodiment of an AIA having an isolating member retained in an unexpanded conformation.
Figure 3B:
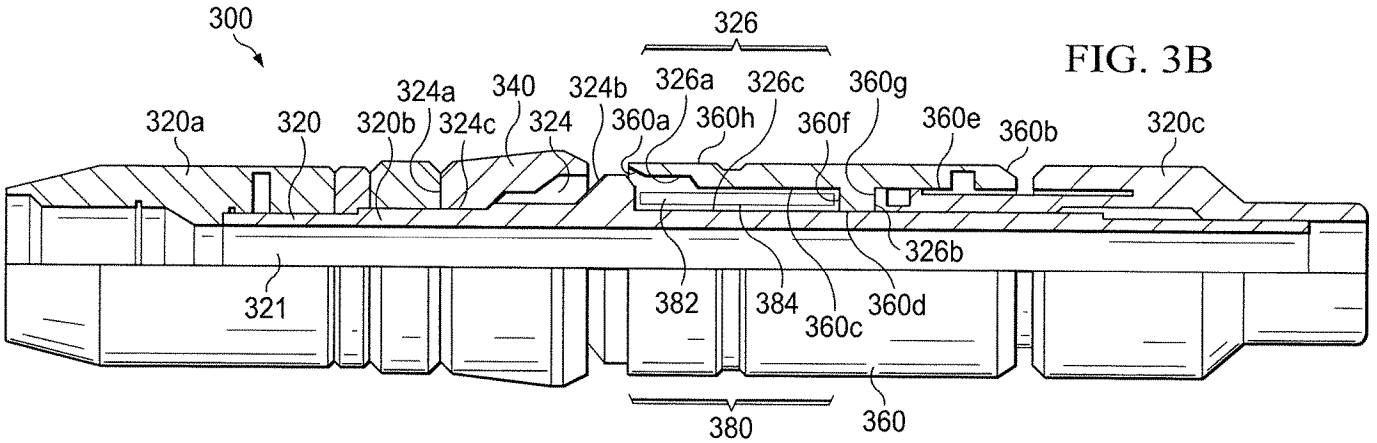
FIG. 3B is a cross-sectional view of the second embodiment of the AIA having an isolating member in an expanded conformation.

Referring FIGS. 3A and 3B, a second embodiment of an AIA 300 is illustrated in the first, locked mode and the second, actuated mode, respectively. In the embodiments of FIGS. 3A and 3B, the AIA 300 generally comprises a housing 320, an isolating member 340, a sliding sleeve 360, and an actuator assemblage 380.

In an embodiment, the housing 220 and/or 320 may be characterized as a generally tubular body defining an axial flowbore 221 and/or 321 having a longitudinal axis. The axial flowbore 221 and/or 321 may be in fluid communication with the axial flowbore 113 defined by the work string 112. For example, a fluid communicated via the axial flowbore 113 of the work string 112 will flow into and/or through the axial flowbore 221 and/or 321.

In an embodiment, the housing 220 and/or 320 may be configured for connection to and/or incorporation within a work string such as work string 112. For example, the housing 220 and/or 320 may comprise a suitable means of connection to the work string 112 (e.g., to a work string member such as coiled tubing, jointed tubing, or combinations thereof). For example, in an embodiment, the terminal ends of the housing 220 and/or 320 comprise one or more internally or externally threaded surfaces, as may be suitably employed in making a threaded connection to the work string 112. Alternatively, an AIA may be incorporated within a work string by any suitable connection, such as, for example, via one or more quick-connector type connections. Suitable connections to a work string member will be known to those of skill in the art viewing this disclosure.

In an embodiment, the housing 220 and/or 320 may comprise a unitary structure; alternatively, the housing 220 and/or 320 may be comprise two or more operably connected components (e.g., two or more coupled sub-components, such as by a threaded connection). Alternatively, a housing like housing 220 and/or 320 may comprise any suitable structure, such suitable structures will be appreciated by those of skill in the art with the aid of this disclosure.

In the embodiment of FIGS. 2A, 2B, and 2C, the housing 220 may be characterized as having a fixed length (i.e., parallel to the axial flowbore 221). In the embodiment of FIGS. 2A, 2B, and 2C, the housing 220 generally comprises a first end portion 220*a*, a mandrel portion 220*b*, and a second end portion 220*c*. In such an embodiment, the first end portion 220*a* may be solidly fixed to the mandrel portion 220*b* such that the first end portion 220*a* is longitudinally and/or radially immovable with respect to the mandrel portion 220*b*. For example, the first end portion 200*a* may be fixed to the mandrel portion 200*b* via a threaded interface, a set screw, or other suitable interface. Also, in such an embodiment, the second end portion 220*c* may be formed as a part of (e.g., integral with or forming a unitary structure) the mandrel portion 220*b* and, as such, the second end portion 220*c* is longitudinally and/or radially immovable with respect to the mandrel portion 220*b*.

In the embodiment of FIGS. 3A and 3B, the housing 320 may be characterized as having a length that is selectively expandable and/or contractable. In the embodiment of FIGS. 3A and 3B, the housing 320 generally comprises a first end portion 320*a*, a mandrel portion 320*b*, and a second end portion 320*c*. In such an embodiment, the first end portion 320*a* may be solidly fixed to the mandrel portion 320*b* such that the first end portion 320*a* is longitudinally and/or radially immovable with respect to the mandrel portion 320*b*. For example, the first end portion 320*a* may be fixed to the mandrel portion 320*b* via a threaded interface, a set screw, or other suitable interface. Also, in such an embodiment, the second end portion 320*c* may be longitudinally, radially, or both longitudinally and radially movable with respect to the mandrel portion 320*b* when the tool is so-configured. For example, the second end portion 320*c* may be slidably positioned within and/or about the mandrel portion 320*b*, as will be disclosed herein below.

In an embodiment, the housing 220/320 comprises an outer profile and/or a combination of outer profiles extending circumferentially about at least a portion of the housing 220/320. In various embodiments, the outer profile may be configured such that the isolating member 240 or 340 and/or the sliding sleeve 260 or 360 may be positioned (e.g., circumferentially) about the housing 220 or 320. For example, in the embodiment of FIGS. 2A, 2B, and 2C and 3A and 3B, the housing 220/320 comprises an isolating member recess 224/324, respectively. The isolating member recess 224/324 may be generally configured such that at least a portion of the isolating member 240/340 may be received therein. In the embodiment of FIGS. 2A, 2B, and 2C, the isolating member recess 224 is generally defined by an upper shoulder 224*a*, a lower shoulder 224*b*, and a recessed cylindrical surface 224*c* extending between the upper shoulder 224*a* and lower shoulder 224*b*. Similarly, in the embodiment of FIGS. 3A and 3B, the isolating member recess 324 is generally defined by an upper shoulder 324*a*, a lower chamfer 324*b*, and a recessed cylindrical surface 324*c* extending between the upper shoulder 324*a* and the lower chamfer 324*b*. In an embodiment, the recessed cylindrical surface 224*c*/324*c* may comprise surfaces varying as to depth.

In the embodiment of FIGS. 2 and 3, the housing 220/320 further comprises a sliding sleeve recess 226/326, respectively. The sliding sleeve recess 226 and/or 326 may generally comprise a passageway in which at least a portion of the sliding sleeve 260/360 may move longitudinally, axially, radially, or combinations thereof about the housing 220/320. In an embodiment, the sliding sleeve recess 226/326 may comprise one or more grooves, guides, pins, or the like, for example, to align and/or orient the sliding sleeve 260. In the embodiment of FIGS. 2A, 2B, and 2C, the sliding sleeve recess 226 is generally defined by an upper shoulder 226*a*, a lower shoulder 226*b*, and the cylindrical surface 226*c* extending between the upper shoulder 226*a* and lower shoulder 226*b*. Similarly, in the embodiment of FIGS. 3A and 3B, the sliding sleeve recess 326 is generally defined by an upper shoulder 326*a*, a lower shoulder 326*b*, and the cylindrical surface 326*c* extending between the upper shoulder 326*a* and the lower shoulder 326*b*.

In an embodiment, the isolating member 240/340 generally comprises a pliable, at least partially-cylindrical structure. The isolating member 240/340 may generally be configured to sealingly and slidably engage an inner bore surface, for example, such as the inner bore of the casing or liner 120 and/or an inner wellbore wall in an uncased section of the wellbore. In an embodiment, the isolating member 240/340 may be characterized as radially expandable and/or contractable. In an embodiment, the isolating member 240 and/or 340 may expand into a wider, expanded conformation when not retained in a narrower, non-expanded conformation. For example, in the embodiment of FIGS. 2A and 3A, isolating members 240 and 340 are illustrated being retained in the narrower, non-expanded conformation and in the embodiment of FIGS. 2B, 2C, and 3B, the isolating members 240 and 340 are illustrated in the wider, expanded conformation. In an embodiment, the isolating member 240/340 comprises a cup packer. Such a cup packer may be configured to restrict fluid movement in one direction while allowing some fluid communication in the opposite direction. In an embodiment, a cup packer may be configured such that the application of fluid pressure to one side of the cup packer causes the cup packer to expand laterally and/or radially. For example, in the embodiment of FIGS. 2 and 3, the isolating member 240/340 is configured as a cup packer generally comprising a substantially concave profile that faces the fluid pressure to be isolated. As such, application of fluid pressure to the cup packer, particularly, to the concave profile to the isolating member, may cause the isolating member to expand laterally and/or radially. The isolating member 240/340 may be provided in a suitable number and/or configuration, as will be appreciated by one of skill in the art viewing this disclosure.

In an embodiment, the isolating member 240 and/or 340 may be formed from a suitable material. Such a suitable material may be characterized as conformable or pliable, for example, such that the isolating member 240 and/or 340 may be able to conform to inconsistencies in the inner wellbore surface. Examples of suitable materials include but are not limited to an elastomeric material (e.g., rubber), a foam, a plastic, or combinations thereof.

In an embodiment, the isolating member 240 and/or 340 may be configured to have a suitable and/or desirable outside diameter in the non-expanded conformation, the expanded conformation, or both. For example, the isolating member may be configured such that the isolating member will sealably and slidably engage an inner wellbore surface of a particular size and/or configuration, for example, so as to restrict, impair, or prohibit fluid movement in at least one direction. The expandable isolating member 240 and/or 340 may extend radially outward from the housing 220 and/or 320 at a suitable angle. For example, in the embodiment of the FIGS. 2A, 2B, 3A, and 3B the isolating member is angled, thereby forming an at least partially conical cross-section (e.g., a cup packer).

In an embodiment, the sliding sleeve 260 and/or 360 generally comprises a cylindrical or tubular structure. In the embodiment of FIGS. 2A, 2B, and 2C, the sliding sleeve 260 generally comprises an upper chamfer 260*a*, a lower face 260*b*, a first inner cylindrical surface 260*c*, a second inner cylindrical surface 260*d*, a shoulder 260*e*, and an outer cylindrical surface 260*f*. In the embodiment of FIGS. 3A and 3B, the sliding sleeve 360 generally comprises an upper chamfer 360*a*, a lower face 360*b*, a first inner cylindrical surface 360*c*, a second inner cylindrical surface 360*d*, a third inner cylindrical surface 360*e*, shoulders 360*f*, 360*g*, and 360*i*, and an outer cylindrical surface 360*h*.

In an embodiment, the sliding sleeve 260 and/or 360 may comprise a single component piece. In an alternative embodiment, a sliding sleeve may comprise two or more operably connected or coupled component pieces.

In an embodiment, the sliding sleeve 260 and/or 360 may be slidably and concentrically positioned about the housing 220 and/or 320. In the embodiment of FIGS. 2A, 2B, and 2C at least a portion of the sliding sleeve 260 may be positioned circumferentially about at least a portion of the sliding sleeve recess 226 of the housing 220. For example, at least a portion of the inner cylindrical surface 260*d* of the sliding sleeve 260 may be slidably fitted against at least a portion of the cylindrical surface 226*c*. In the embodiment of FIGS. 3A and 3B, at least a portion of the sliding sleeve 360 may be positioned circumferentially about the sliding sleeve recess 326 of the housing 320. For example, as least a portion of the inner cylindrical surface 360*d* may be slidably fitted against at least a portion of the cylindrical surface 326*c*.

In an embodiment, the sliding sleeve 260 and/or 360, the sliding sleeve recess 226 and/or 326, or both may comprise one or more seals at the interface there between. For example, in an embodiment, the sliding sleeve 260 and/or 360 further comprises one or more radial or concentric recesses or grooves configured to receive one or more suitable fluid seals such as fluid seals, for example, to restrict fluid movement via the interface between the sliding sleeve 260 and/or 360 and the sliding sleeve recess 226 and/or 326. Suitable seals include but are not limited to a T-seal, an O-ring, a gasket, or combinations thereof.

In an embodiment, the sliding sleeve 260 and/or 360 may be slidably movable between a first position and a second position with respect to the housing 220 and/or 320. Referring again to FIGS. 2A and 3A, the sliding sleeves 260 and 360 are shown in the first position. In the embodiment of FIG. 2A, in the first position, the shoulder 260*e* sliding sleeve 260 may abut and/or be located substantially adjacent to the upper shoulder 226*a* of the sliding sleeve recess 226. In the embodiment of FIG. 3A, in the first position, the shoulder 360*i* of the sliding sleeve 326 may abut the upper shoulder 326*a* of the sliding sleeve recess 326. Referring again to FIGS. 2B, 2C and 3B, the sliding sleeve 260 and 360 are shown in the second position. In the embodiment of FIGS. 2B and 2C, in the second position, the lower surface 260*b* of the sliding sleeve 260 may be located substantially adjacent to the lower shoulder 226*b* of the sliding sleeve recess 226. In the embodiment of FIG. 3B, in the second position, shoulder 360*g* of the sliding sleeve 360 may abut a lower shoulder 226*b* of the sliding sleeve recess 226, which may be formed by the second end portion 320*c*.

In the embodiment of FIGS. 2A and 3A, where the sliding sleeves 260 and 360 are in the first position, the sliding sleeves 260 and 360 may be configured to retain the respective isolating member 240 and/or 340 in the non-expanded conformation. In the embodiment of FIGS. 2B, 2C, and 3B, where the sliding sleeves 260 and 360 are in the second position, the sliding sleeves 260 and 360 may allow the respective isolating member 240 and/or 340 to expand into the expanded conformation, that is in the sliding sleeves 260 and 360 may be configured to not retain the respective isolating member 240/340 in the non-expanded conformation. Particularly, in the first position, the upper chamfer 260*a* or 360*a* of the sliding sleeve 260/360 may engage a portion of the isolating member 240/340 at an interface 250/350 to retain the isolating member 240 or 340. At the interface 250/350, the sliding sleeve 260/360 contacts and/or interacts in close proximity with at least a portion of the isolating member 240/340 (e.g., a lip). In the second position, the sliding sleeve 260 or 360 may not so engage the isolating member 240 or 340.

In an embodiment, the sliding sleeve 260 and/or 360 may be held in the first position and/or the second position by a suitable retaining mechanism. For example, in the embodiment of FIGS. 2A and 3A, the sliding sleeves 260 and 360 are each retained in the first position by a locking mechanism such as a frangible member, particularly, one or more shear-pins 268 and/or 368 or the like. In the embodiment of FIG. 2A, the shear pin 268 is received by shear-pin bore within the sliding sleeve 260 and shear-pin bore in the mandrel portion 220*b* of the housing 220. In the embodiment of FIG. 3A, the shear pin 368 is received by shear-pin bore within the sliding sleeve 360 and shear-pin bore or groove in the second end portion 320*c* of the housing 320. In the embodiment of FIGS. 2B and 2C, the sliding sleeve 260 may be retained in the second position by a snap-ring 227 that is carried within a groove within the sliding sleeve 260.

In an embodiment, the actuator assemblage 280/380 generally comprises one or more devices, assemblies, apparatuses, or combinations thereof configured to selectively cause, effectuate, or allow movement of the sliding sleeve 260 and/or 360 from the first position to the second position, as disclosed above.

Referring to FIGS. 2A, 2B, and 2C, in an embodiment, the actuator assemblage generally comprises a fluid chamber 282, a fluid aperture 284, and an obturating member assembly 286.

In the embodiment of FIGS. 2A, 2B, and 2C, the housing 220 and the sliding sleeve 260 cooperatively define the fluid reservoir 282. Particularly, the fluid reservoir 282 is substantially defined by the cylindrical surface 226*c* of the sliding sleeve recess 226, a shoulder within the sliding sleeve recess 226, the shoulder 260*e* of the sliding sleeve 260, and the inner cylindrical surface 260*c* of the sliding sleeve 260. In an embodiment, the fluid chamber 282 may be of any suitable size, as will be appreciated by one of skill in the art viewing this disclosure. The fluid chamber 282 may comprises a variable volume. For example, in an embodiment, as shown in FIGS. 2A, 2B, and 2C, the fluid chamber 282 may be positioned and/or arranged such that expansion of the fluid chamber 282 (e.g., longitudinal expansions, resulting from the inflow of a fluid into the fluid chamber 282) may cause the sliding sleeve 260 to move from the first position to the second position, as will be discussed herein.

In the embodiment of FIGS. 2A, 2B, and 2C, the fluid aperture 284 provides a route of fluid communication between the axial flowbore 221 and the fluid chamber 282, for example, such that a fluid flowing via the axial flowbore 221 may flow into the fluid chamber 282 via the fluid aperture 284 as represented by flow arrows in FIG. 2B. In an embodiment, a fluid aperture like fluid aperture 284 may comprise or be fitted with a fluid pressure and/or fluid flow-rate altering device, such as a nozzle or a metering device such as a fluidic diode. In an embodiment, a fluid aperture like fluid aperture 284 may be sized to allow a given flow-rate of fluid, and thereby provide a desired opening time or delay associated with the movement of the sliding sleeve.

In the embodiment of FIGS. 2A, 2B, and 2C, the obturating member assembly 286 may comprise any assembly suitably configured to divert at least a portion of the fluid moving via the axial flowbore 221 into the fluid chamber 282 via the fluid aperture 284. In the embodiment of FIGS. 2A, 2B, and 2C, the obturating member assembly comprises a seat 287 configured to engage and retain an obturator 288, as shown in FIG. 2B. In such an embodiment, the seat 287 generally comprises an inner bore generally defining a flowbore having a reduced diameter relative to the diameter of axial flowbores 221, a bevel or chamfer at the reduction in flowbore diameter, and a lower face. A seat like seat 287 may be formed from any suitable material. In an embodiment, a seat like seat 287 may be removable. For example, a seat like seat 287 may be characterized as drillable, frangible, breakable, dissolvable, or combinations thereof. Examples of suitable materials include but are not limited to phenolics, alloys, plastics, rubbers, ceramics, the like, or combinations thereof. In an embodiment, the seat 287 may be retained within the axial flowbore 221 by any suitable means. For example, the seat 287 may be retained by a plurality of shear pins, set screws, or the like. In an embodiment, the obturator 288 may comprise any structure or device configured to engage the seat 287 and, thereby, restrict or lessen the movement of fluid via the axial flowbore 221. Suitable examples of an obturator like obturator 288 include a ball or dart. In an embodiment, the obturator 288 may also be characterized as drillable, frangible, breakable, dissolvable, or combinations thereof.

Figure 4:
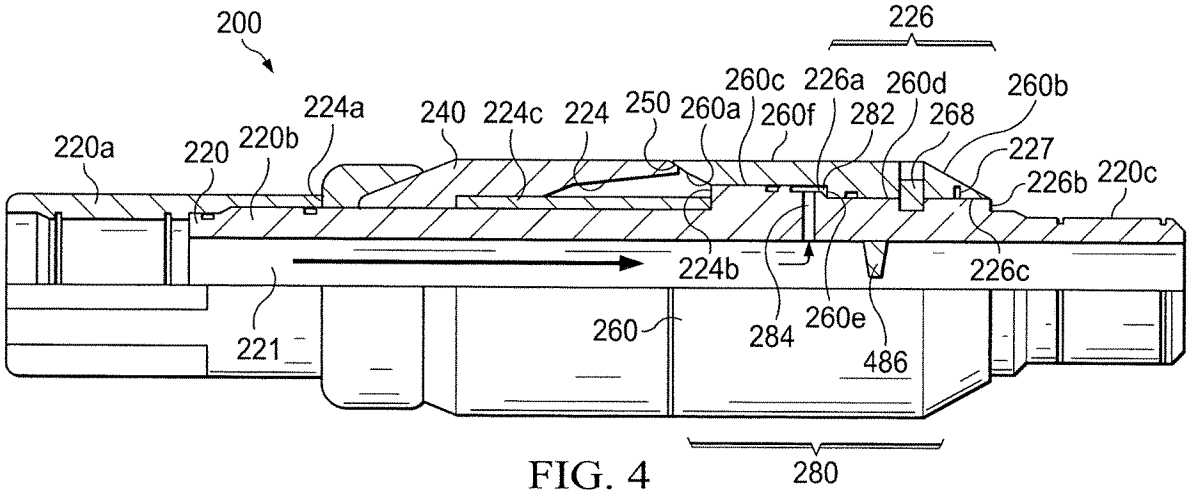
FIG. 4 is a cross-sectional view of an alternative embodiment of the AIA of FIGS. 2A, 2B, and 2C having an isolating member retained in an unexpanded conformation.

Referring to FIG. 4, an alternative embodiment of the obturating member assembly 486 is illustrated. In the embodiment of FIG. 4, the obturating member assembly 486 comprises a fluid restrictive device such as a burst disc. In such an embodiment, the burst disc may generally comprise any suitable structure or device configured to selectively divert at least a portion of the fluid moving via the axial flowbore 221 to the fluid chamber 282 via fluid aperture 284 (thereby actuating the sliding sleeve) at a first, relatively lower pressure and to burst, rupture, disintegrate, or the like at a second higher pressure, thereby allow fluid movement via the axial flowbore 221. The burst disc may be formed from any suitable material. Examples of suitable materials include but are not limited to plastics, ceramics, composites, metals, metallic alloys, the like, or combinations thereof. In an embodiment, the burst disc may be removable. For example, the burst disc may be characterized as frangible, breakable, dissolvable, or combinations thereof. In an embodiment, the burst disc may be retained within the axial flowbore 221 by any suitable means. For example, the burst disc may be retained by a locking mechanism such as a frangible member (e.g., a plurality of shear pins), set screws, or the like.

Referring to FIGS. 3A and 3B, in an embodiment, the actuator assemblage generally comprises a biasing chamber 382 and a biasing member 384.

In the embodiment of FIGS. 3A and 3B, the housing 320 and the sliding sleeve 360 cooperatively define the biasing chamber 382. Particularly, the biasing chamber 382 is substantially defined by the by the cylindrical surface 326*c* of the sliding sleeve recess 326, upper shoulder 326*a* of the sliding sleeve recess 326, the first inner cylindrical surface 360*c* of the sliding sleeve 360, and shoulder 360*f* of the sliding sleeve. In an embodiment, the biasing chamber 382 may be of any suitable size, as will be appreciated by one of skill in the art viewing this disclosure. In an embodiment, for example, as shown in FIGS. 3A and 3B, the biasing chamber 382 may be positioned and/or arranged such that expansion of the biasing chamber 382 (e.g., longitudinal expansions, resulting from the expansion of the biasing member) may cause the sliding sleeve 360 to move from the first position to the second position when the sliding sleeve 360 is not retained (locked) in the first position (for example, as by shear pins 368), as will be discussed herein.

In the embodiment of FIGS. 3A and 3B, the biasing member 384 generally comprises a suitable structure or combination of structures configured to apply a directional force and/or pressure to the sliding sleeve 360 with respect to the housing 320. Examples of suitable biasing members include a spring, a compressible fluid or gas contained within a suitable chamber, an elastormeric composition, or the like. For example, in the embodiment of FIGS. 3A and 3B, the biasing member 384 comprises a spring.

In an embodiment, the biasing member 384 (e.g., a coil spring) may be concentrically positioned within the biasing chamber 382. The biasing member 384 may be configured to apply a directional force to the sliding sleeve 360. For example, in the embodiment of FIGS. 3A and 3B, the biasing member 384 is configured to apply a force to the sliding sleeve 360 to move the sliding sleeve 360 from the first position to the second when the sliding sleeve 360 is not retained (e.g., locked) in the first position.

One or more of embodiments of an AIA (e.g., AIA 200 and AIA 300) and a wellbore servicing system comprising one or more AIAs having been disclosed, also disclosed herein are one or more embodiments of a wellbore servicing method employing such an AIA and/or wellbore servicing system comprising one or more AIA clusters. In an embodiment, a wellbore servicing method generally comprises the steps of positioning a work string comprising one or more AIAs and a tool assembly (e.g., a stimulation assembly) within a wellbore such that the tool assembly (e.g., stimulation assembly) is proximate to a zone of a subterranean formation, actuating the one or more AIAs, and communicating a servicing fluid from to the zone of the subterranean formation via tool assembly (e.g., stimulation assembly).

Referring again to FIGS. 1A and 1B, in an embodiment, one or more AIAs, such as AIA 200 and/or AIA 300, may be incorporated within a work string such as work string 112, for example as disclosed herein. In the embodiment of FIG. 1A, the AIA 200 or 300 is incorporated within the work string 112 above the WSA 150 and the wellbore stimulation assembly is incorporated within the work string 112 above the packer. In an alternative embodiment, an AIA like AIA 200 may be incorporated within the work string 112 below the WSA 150 and the WSA may be incorporated within the work string 112 below the packer 130. Referring to FIG. 1B, the upper AIA 200X is incorporated within the work string 112 above the WSA 150 and the lower AIA 200Y is incorporated below the wellbore stimulation assembly, the upper AIA being configured to restrict the upward movement of fluid and the lower AIA 200Y being configured to restrict the downward movement of fluid. In an of these embodiments, the work string 112 may be positioned within the wellbore 114 such that the WSA 150 is located proximate and/or substantially adjacent to a formation zone (e.g., at least one of formation zones 2, 4, 6, 8, 10, and/or 12) which is to be serviced. Alternatively, the work string 112 may positioned at any suitable depth within the wellbore 114. For example, the work sting 112 may be "run-in" a portion of the distance to a given formation zone (e.g., one of formation zones 2, 4, 6, 8, 10, and/or 12) before the AIA 200 and/or 300 is actuated. In an embodiment, the AIA(s) 200 and/or 300 may be positioned within the wellbore 114 in the first, locked, run-in, or installation configuration (e.g., in a configuration in which the AIA will retain the isolating member in the non-expanded conformation).

In an embodiment, when the work string 112 has been placed within the wellbore 114 at the point where it is desired to actuate the AIA 200 and/or 300, the AIA 200 and/or 300 may be transitioned from the first mode or configuration to the second mode or configuration, thereby actuating the AIA 200 and/or 300 to restrict fluid communication in at least one direction.

In an embodiment where the AIA is configured substantially similarly to AIA 200, transitioning the AIA 200 from the first mode to the second mode may generally comprise the steps of diverting fluid from the axial flowbore 221 into the fluid chamber, continuing to cause fluid to flow into the fluid chamber until the sliding sleeve 240 has transitioned from the first position to the second position, and providing fluid communication via the axial flowbore 221.

Referring to FIG. 2A, the AIA 200 is illustrated in the first configuration. Referring to FIG. 2B and to FIG. 4, to transition the AIA 200 from the first configuration to the second configuration fluid is diverted from the axial flow 221 into the fluid chamber 282 via the fluid aperture 284. For example, in the embodiment of FIG. 2B, an obturator 288 is introduced into the work string 112 and forward-flowed to engage the seat 287. Upon engaging the seat 287, the obturator 288 provides a substantial fluid seal to the continued circulation of fluid. Alternatively, an obturating member such as burst disk, the obturating member of FIG. 4, may be placed within the AIA 200 prior to positioning the AIA within the wellbore 114.

With the obturating member obstructing fluid communication via the axial flowbore 221, continued application of fluid pressure to the axial flowbore 221 causes fluid to flow into fluid chamber 282 via the fluid aperature 284. As fluid flows into the fluid chamber 282, the fluid exerts a fluid pressure against the sliding sleeve 260, particularly, against the shoulder 260*e*, causing the shear pin(s) 268 to break and the sliding sleeve 260 to move from the first position to the second position.

As the sliding sleeve 260 moves from the first position to the second position, the sliding sleeve 260 moves away from the isolating member 240. Particularly, as the sliding sleeve moves from the first position to the second position, the upper chamfer 260*a* of the sliding sleeve 260 may disengage the isolating member and, thereby, no longer retain the isolating member 240 in the non-expanded conformation.

When the sliding sleeve 260 reaches the second position, the snap-ring 227 may extend and lock against the lower shoulder 226*b*, thereby locking the sliding sleeve 260 in the second position. In an embodiment, the sliding sleeve 260 may be inhibited from moving beyond the second position by a connecting collar coupled to the second end portion 220*c*. Additionally and/or alternatively, the sliding sleeve may be inhibited from moving beyond the second position by a groove into which the snap-ring 227 may extend.

Referring to FIG. 2C, in an embodiment, when the sliding sleeve has reached the second position, a route of fluid communication may be provided through the axial flowbore 221, for example, by removing the obturating member (e.g., obturator 288 and/or seat 287 or burst disk 486). In an embodiment, the obturating member may be frangible. In such an embodiment, the obturating member or some portion thereof may be removed by continuing to apply a fluid force to the axial flowbore until the obturating member breaks, shatters, disintegrates, or the like, and flow downward through the axial flowbore 221. In an alternative embodiment, the obturating member may be dissolvable and may be removed by contacting the obturating member or a portion thereof with a suitable solution to bring about dissolution thereof. In another embodiment, the obturator may be removed by reverse circulation. In still another embodiment, the obturating member or a portion thereof may be drillable and may be removed by drilling through or removed via a fishing tool having a complimentary profile with the seat 287.

Alternatively, in an embodiment where the AIA is configured substantially similarly to AIA 300, transitioning the AIA 300 from the first mode to the second mode may generally comprise the steps of fixing at least a portion of the housing with respect to the formation 102, releasing the sliding sleeve 360, and allowing the sliding sleeve to transition from the first position to the second position.

Referring to FIG. 3A, the AIA 300 is illustrated in the first configuration. To transition the AIA 300 from the first mode to the second mode, the lower end portion 320*c* is fixed with respect to the surrounding formation 102, for example, by setting a packer such as packer 130. Referring again to FIG. 1A, the lower mandrel portion 320*c* is connected to the packer 130 (e.g., via a segment of the work string 112 including the WSA 150). Therefore, setting the packer 130 within the casing 120 will also set the lower end portion 320*c*.

With the lower end portion 320*c* set with respect to the formation 102, movement (e.g., longitudinally upward and/or downward) of the work sting 112 will cause the housing 320 of the AIA to expand or contract. Referring again to FIG. 3A, the lower end portion 320*c* of the AIA 300 is fixed to the sliding sleeve 360 via shear pin 368 and the shoulder 360*i* of the sliding sleeve 326 abuts the upper shoulder 326*a* of the sliding sleeve recess 326, which is formed by a portion of the mandrel portion 320*b* of the AIA 300. Referring to FIG. 3B, downward movement of the upper end portion 320*a* and the mandrel portion 32013 of the 300 applies a downward force via the sliding sleeve 360 while the lower end portion 320*c* is held in place via the packer 130 causes the shear pin(s) 368 to shear or break. In an alternative embodiment, the work string 112 may be moved rotationally or both longitudinally and rotationally to cause the shear pin(s) 368 to break.

Continuing to refer to FIG. 3B, with the sliding sleeve 360 no longer retained in the first position by the shear pin(s) 368, the biasing member 384 moves the sliding sleeve 360 from the first position to the second position. As the sliding sleeve 360 moves from the first position to the second position, the sliding sleeve 360 moves away from the isolating member 340. Particularly, as the sliding sleeve 360 moves from the first position to the second position, the upper chamfer 360*a* of the sliding sleeve 360 may disengage the isolating member 340 and, thereby, no longer retain the isolating member 340 in the non-expanded conformation.

In an embodiment, once the AIA(s) have been transitioned from the first mode or configuration to the second mode or configuration, a suitable wellbore servicing fluid may be communicated to a subterranean formation zone (e.g., one or more of formation zones 2, 4, 6, 8, 10, or 12) via a tool such as the WSA 150. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure. For example, the wellbore servicing fluid may be communicated at a rate and/or pressure sufficient to initiate or extend a fluid pathway (e.g., a perforation or fracture) within the subterranean formation 102. In an embodiment where the WSA 150 is activatable/inactivatable, communicating a servicing fluid may comprise activating such a WSA, for example, by providing a route of fluid communication to the subterranean formation zone.

As the servicing fluid is communicated to the subterranean formation 102, the AIA 200 and/or 300 may restrict fluid communication in at least one direction. With the isolating member in the expanded conformation (e.g., an expanded cup), the isolating member pressures up and sealably engages the inner bore of the casing 120 and, thereby, restricts, impairs, or prohibits fluid movement in at least one direction. Particularly, the at least partially conical cross-section of the isolating member 240 or 340 may be configured such that fluid pressure may cause the isolating member 240 or 340 to more tightly engage the inner wall of the casing 120 (e.g., expand the cup into sealing engagement with the wellbore surface).

In an embodiment, an AIA such as AIA 200 and/or AIA 300 may be advantageously employed in the performance of a wellbore servicing operation. For example, the ability to place an AIA some depth within a wellbore before actuating the AIA will allow AIA to be deployed a greater depths within a wellbore that would have been unreachable by prior art devices. Further, the ability to selectively actuate an AIA within a wellbore when the AIA is needed means decreases the risk that such an AIA will become inoperable during placement within a wellbore, thereby increasing the reliability with which wellbore servicing operations, such as those disclosed herein, may be performed and decreasing the costs and downtime previously associated with such servicing operations.

ADDITIONAL DISCLOSURE

The following are nonlimiting, specific embodiments in accordance with the present disclosure:

Embodiment A

An actuatable wellbore isolation assembly comprising:

a housing generally defining an axial flowbore and comprising a mandrel portion, a first end portion, and a second end portion;

a radially expandable isolating member positioned circumferentially about a portion of the housing;

a sliding sleeve circumferentially positioned about a portion of the mandrel of the cylindrical housing, the sliding sleeve being movable from;

- a first position in which the sliding sleeve retains the expandable isolating member in a narrower non-expanded conformation to
- a second position in which the sliding sleeve does not retain the expandable isolating member in the narrower non-expanded conformation; and an actuator assemblage configured to selectively allow movement of the sliding sleeve from the first position to the second position.

Embodiment B

The actuatable wellbore isolation device of embodiment A, wherein the expandable isolating member comprises an elastomeric material, a foam, a plastic, or combinations thereof.

Embodiment C

The actuatable wellbore isolation device of one of embodiments A through B, wherein the actuator assemblage comprises a fluid chamber and an aperture, wherein the fluid aperture provides a route of fluid communication between the axial flowbore and the fluid chamber.

Embodiment D

The actuatable wellbore isolation device of embodiment C, wherein the actuator assemblage further comprises an obturating assembly, wherein the obturating assembly is configured to divert fluid into the fluid chamber via the fluid aperture.

Embodiment E

The actuatable wellbore isolation device of embodiment D, wherein the obturating member is characterized as drillable, frangible, breakable, dissolvable, degradable, or combinations thereof.

Embodiment F

The actuatable wellbore isolation device of embodiment D, further comprising a seat disposed within the axial flowbore, and wherein the obturating member comprises a ball or dart.

Embodiment G

The actuatable wellbore isolation device of embodiment D, wherein the obturating member comprises a burst disc.

Embodiment H

The actuatable wellbore isolation device of embodiment D, wherein the housing comprises a fixed length.

Embodiment I

The actuatable wellbore isolation device of one of embodiments A through B, wherein the actuator assemblage comprises a biasing chamber having a biasing member disposed therein, wherein the biasing member is configured to apply a force to the sliding sleeve to move the sliding sleeve from the first position to the second position.

Embodiment J

The actuatable wellbore isolation device of embodiment I, wherein the housing comprises a variable length.

Embodiment K

The actuatable wellbore isolation device of embodiment J, wherein the second end portion is longitudinally, radially, or both longitudinally and radially slidable with respect to the mandrel portion.

Embodiment L

The actuatable wellbore isolation device of one of embodiments A through K, wherein the sliding sleeve is retained in the first position and/or the second position by a locking mechanism.

Embodiment M

An actuatable wellbore isolation system comprising:

a wellbore stimulation assembly, wherein the wellbore stimulation assembly is incorporated within a work string; and a first actuatable wellbore isolation assembly, wherein the first actuatable wellbore isolation assembly is incorporated within the work string above the wellbore stimulation assembly, the first actuatable wellbore isolation assembly comprising:

a housing generally defining an axial flowbore and comprising a mandrel portion, a first end portion, and a second end portion;

a radially expandable isolating member positioned circumferentially about a portion of the housing;

a sliding sleeve circumferentially positioned about at portion of the mandrel of the cylindrical housing, the sliding sleeve being movable from;

a first position in which the sliding sleeve retains the expandable isolating member in a narrower non-expanded conformation to a second position in which the sliding sleeve does not retain the expandable isolating member in the narrower non-expanded conformation; and an actuator assemblage configured to selectively allow movement of the sliding sleeve from the first position to the second position.

Embodiment N

The actuatable wellbore isolation system of embodiment M, further comprising a casing string, wherein the casing string is disposed within a wellbore, wherein the work string is disposed within the casing string.

Embodiment O

The actuatable wellbore isolation system of one of embodiments M through N, further comprising a second actuatable wellbore isolation assembly, wherein the second actuatable wellbore isolation assembly is incorporated within the work string below the wellbore stimulation assembly.

Embodiment P

The actuatable wellbore isolation system of one of embodiments M though O, further comprising a packer, wherein the packer is incorporated within the work string below the wellbore stimulation assembly.

Embodiment Q

A wellbore isolation method comprising:

positioning a work string within a wellbore, wherein the work string comprises:

a wellbore servicing tool, wherein the wellbore servicing tool is incorporated within the work string; and a actuatable wellbore isolation assembly, wherein the actuatable wellbore isolation assembly is incorporated within the work string above the wellbore stimulation assembly, the actuatable wellbore isolation assembly comprising:

a housing generally defining an axial flowbore and comprising a mandrel portion, a first end portion, and a second end portion;

a radially expandable isolating member positioned circumferentially about a portion of the housing;

a sliding sleeve circumferentially positioned about a portion of the mandrel of the cylindrical housing, the sliding sleeve being movable from; and an actuator assemblage configured to selectively allow movement of the sliding sleeve from the first position to the second position;

actuating the actuatable wellbore isolation assembly, wherein actuating the actuatable wellbore isolation assembly comprises transitioning the sliding sleeve from a) a first position in which the sliding sleeve retains the expandable isolating member in a narrower non-expanded conformation to b) a second position in which the sliding sleeve does not retain the expandable isolating member in the narrower non-expanded conformation; and communicating a wellbore servicing fluid via the wellbore servicing tool, wherein the actuatable wellbore isolation assembly substantially restricts fluid movement in at least one direction via an annular space between the work string and an inner surface of the wellbore.

Embodiment R

The wellbore isolation method of embodiment Q, wherein the expandable isolating member does not engage the inner surface of the wellbore when retained in the narrower non-expanded conformation and, wherein the expandable isolating member engages the inner surface of the wellbore when not retained in narrower non-expanded conformation.

Embodiment S

The wellbore isolation method of one of embodiments Q through R, wherein actuating the actuatable wellbore isolation assembly comprises introducing a fluid via the axial flowbore, wherein the fluid flows into a fluid chamber within the actuatable wellbore isolation assembly, and wherein fluid flowing into the fluid chamber causes the sliding sleeve to move from the first position to the second position.

Embodiment T

The wellbore isolation method of one of embodiments Q through S, wherein actuating the actuatable wellbore isolation assembly comprises:

setting the second end portion with respect to the casing;

moving the first end portion longitudinally, rotationally, or combination thereof longitudinally and radially with respect to the second end portion, wherein movement of the first end portion with respect to the second end portion allows a biasing member to move the sliding sleeve from the first position to the second position.

Embodiment U

A wellbore isolation assembly comprising:

a housing generally defining an axial flowbore and comprising a mandrel portion, a first end portion, and a second end portion;

a cup packer positioned circumferentially about a portion of the housing, wherein the cup packer comprises a concave surface, and wherein the cup packer is configured to expand radially upon application of a fluid pressure to the concave surface;

a sliding sleeve circumferentially positioned about a portion of the mandrel of the cylindrical housing, the sliding sleeve being movable from;

a first position in which the sliding sleeve retains the cup packer in a narrower non-expanded conformation and the concave surface of the cup packer is not exposed;

a second position in which the sliding sleeve does not retain the cup packer in the narrower non-expanded conformation and the concave surface is exposed; and an actuator assemblage configured to selectively allow movement of the sliding sleeve from the first position to the second position.

Embodiment V

The wellbore isolation assembly of embodiment U, wherein the cup packer further comprises an inner cylindrical surface having an inner diameter about equal to the outer diameter of the portion of the housing about which the cup packer is positioned, wherein the concave surface extends radially outward from the inner cylindrical surface.

Embodiment W

The wellbore isolation assembly of embodiment V, wherein the concave surface comprises:

a first radial diameter about equal to the outer diameter of the portion of the housing about which the cup packer is positioned; and a second radial diameter greater than the first radial diameter.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An actuatable wellbore isolation assembly comprising:

a housing generally defining an axial flowbore and comprising a mandrel portion, a first end portion, and a second end portion, the mandrel portion being movable relative to the second end portion so that the housing has a variable length;

a radially expandable isolating member positioned circumferentially about a portion of the housing;

a sliding sleeve circumferentially positioned about a portion of the mandrel of the housing, the sliding sleeve being configured to be movable between:

a first position in which the sliding sleeve retains the expandable isolating member in a narrower non-expanded conformation; and a second position in which the sliding sleeve does not retain the expandable isolating member in the narrower non-expanded conformation;

an actuator assemblage configured to move the sliding sleeve from the first position to the second position; and a locking mechanism engaged to retain the sliding sleeve in the first position and disengageable to allow movement of the sliding sleeve between the first position and the second position, wherein movement of the mandrel portion relative to the second end portion disengages the locking mechanism to thereby allow the actuator assemblage to move the sliding sleeve from the first position to the second position.

2. The actuatable wellbore isolation device of claim 1, wherein the expandable isolating member comprises an elastomeric material, a foam, a plastic, or combinations thereof.

3. The actuatable wellbore isolation device of claim 1, wherein the actuator assemblage comprises a biasing chamber having a biasing member disposed therein, wherein the biasing member is configured to apply a force to the sliding sleeve to move the sliding sleeve from the first position to the second position.

4. The actuatable wellbore isolation device of claim 3, wherein disengagement of the locking mechanism allows the biasing member to move the sliding sleeve from the first position to the second position.

5. An actuatable wellbore isolation system comprising:

a wellbore stimulation assembly, wherein the wellbore stimulation assembly is incorporated within a work string; and a first actuatable wellbore isolation assembly, wherein the first actuatable wellbore isolation assembly is incorporated within the work string above the wellbore stimulation assembly, the first actuatable wellbore isolation assembly comprising:

a housing generally defining an axial flowbore and comprising a mandrel portion, a first end portion, and a second end portion, the mandrel portion being movable relative to the second end portion so that the housing has a variable length;

a radially expandable isolating member positioned circumferentially about a portion of the housing;

a sliding sleeve circumferentially positioned about at portion of the mandrel of the housing, the sliding sleeve being configured to be movable between:

a first position in which the sliding sleeve retains the expandable isolating member in a narrower non-expanded conformation; and a second position in which the sliding sleeve does not retain the expandable isolating member in the narrower non-expanded conformation;

an actuator assemblage configured to selectively allow movement of the sliding sleeve from the first position to the second position; and a locking mechanism engaged to retain the sliding sleeve in the first position and disengageable to allow movement of the sliding sleeve between the first position and the second position, wherein movement of the mandrel portion relative to the second end portion disengages the locking mechanism to thereby allow the actuator assemblage to move the sliding sleeve from the first position to the second position.

6. The actuatable wellbore isolation system of claim 5, further comprising a casing string, wherein the casing string is disposed within a wellbore, wherein the work string is disposed within the casing string.

7. The actuatable wellbore isolation system of claim 6, wherein the actuator assemblage comprises a biasing chamber having a biasing member disposed therein, wherein the biasing member is configured to apply a force to the sliding sleeve to move the sliding sleeve from the first position to the second position.

8. The actuatable wellbore isolation system of claim 7, wherein disengagement of the locking mechanism allows the biasing member to move the sliding sleeve from the first position to the second position.

9. The actuatable wellbore isolation system of claim 7, further comprising a second actuatable wellbore isolation assembly, wherein the second actuatable wellbore isolation assembly is incorporated within the work string below the wellbore stimulation assembly.

10. The actuatable wellbore isolation system of claim 9, further comprising a packer, wherein the packer is incorporated within the work string below the wellbore stimulation assembly.

11. A wellbore isolation method comprising:

positioning a work string within a wellbore, wherein the work string comprises:

a wellbore servicing tool, wherein the wellbore servicing tool is incorporated within the work string; and an actuatable wellbore isolation assembly, wherein the actuatable wellbore isolation assembly is incorporated within the work string above a wellbore stimulation assembly, the actuatable wellbore isolation assembly comprising:

a housing generally defining an axial flowbore and comprising a mandrel portion, a first end portion, and a second end portion, the mandrel portion being movable relative to the second end portion so that the housing has a variable length;

a radially expandable isolating member positioned circumferentially about a portion of the housing;

a sliding sleeve circumferentially positioned about a portion of the mandrel of the housing;

an actuator assemblage configured to selectively allow movement of the sliding sleeve from a first position to a second position; and a locking mechanism engaged to retain the sliding sleeve in a first position and disengageable to allow movement of the sliding sleeve between the first position and a second position;

actuating the actuatable wellbore isolation assembly, wherein actuating the actuatable wellbore isolation assembly comprises effecting movement of the mandrel portion relative to the second end portion to thereby disengage the locking mechanism so that the actuator assembly is allowed to move the sliding sleeve from a) the first position in which the sliding sleeve retains the expandable isolating member in a narrower non-expanded conformation to b) the second position in which the sliding sleeve does not retain the expandable isolating member in the narrower non-expanded conformation; and communicating a wellbore servicing fluid via the wellbore servicing tool, wherein the actuatable wellbore isolation assembly substantially restricts fluid movement in at least one direction via an annular space between the work string and an inner surface of the wellbore.

12. The wellbore isolation method of claim 11, wherein the expandable isolating member does not engage the inner surface of the wellbore when retained in the narrower non-expanded conformation and, wherein the expandable isolating member engages the inner surface of the wellbore when not retained in narrower non-expanded conformation.

13. The wellbore isolation method of claim 11, wherein actuating the actuatable wellbore isolation assembly comprises:

setting the second end portion with respect to the casing;

moving the first end portion longitudinally, rotationally, or combination thereof longitudinally and radially with respect to the second end portion, wherein movement of the first end portion with respect to the second end portion allows a biasing member to move the sliding sleeve from the first position to the second position.

14. A wellbore isolation assembly comprising:

a housing generally defining an axial flowbore and comprising a mandrel portion, a first end portion, and a second end portion, the mandrel portion being movable relative to the second end portion so that the housing has a variable length;

a cup packer positioned circumferentially about a portion of the housing, wherein the cup packer comprises a concave surface, and wherein the cup packer is configured to expand radially upon application of a fluid pressure to the concave surface;

a sliding sleeve circumferentially positioned about a portion of the mandrel of the housing, the sliding sleeve being configured to be movable between:

a first position in which the sliding sleeve retains the cup packer in a narrower non-expanded conformation and the concave surface of the cup packer is not exposed; and a second position in which the sliding sleeve does not retain the cup packer in the narrower non-expanded conformation and the concave surface is exposed;

an actuator assemblage configured to selectively allow movement of the sliding sleeve from the first position to the second position, the actuator assemblage comprising a biasing chamber having a biasing member disposed therein, the biasing member being configured to apply a force to the sliding sleeve to move the sliding sleeve from the first position to the second position; and a locking mechanism is engaged to retain the sliding sleeve in the first position and disengageable to allow movement of the sliding sleeve between the first position and the second position, wherein movement of the mandrel portion relative to the second end portion disengages the locking mechanism to thereby allow the actuator assemblage to move the sliding sleeve from the first position to the second position.

15. The wellbore isolation assembly of claim 14, wherein the cup packer further comprises an inner cylindrical surface having an inner diameter about equal to the outer diameter of the portion of the housing about which the cup packer is positioned, wherein the concave surface extends radially outward from the inner cylindrical surface.

16. The wellbore isolation assembly of claim 15, wherein the concave surface comprises:

a first radial diameter about equal to the outer diameter of the portion of the housing about which the cup packer is positioned; and a second radial diameter greater than the first radial diameter.

* * * * *